US006064356A

United States Patent [19]

Shigeta

[11] Patent Number: 6,064,356

[45] Date of Patent: May 16, 2000

[54] DRIVING SYSTEM FOR A SELF-LUMINOUS DISPLAY

[75] Inventor: Tetsuya Shigeta, Yamanashi-ken, Japan

[73] Assignee: Pioneer Electronics Corporation, Tokyo, Japan

[21] Appl. No.: 08/955,951

[22] Filed: Oct. 22, 1997

[30] Foreign Application Priority Data

Oct. 22, 1996 [JP] Japan ..... 8-279662

[51] Int. Cl.[7] ..... G09G 3/28

[52] U.S. Cl. ..... 345/63; 345/148; 345/149; 345/89; 345/204

[58] Field of Search ..... 345/136, 137, 345/148, 149, 58, 42, 50, 63, 77, 84, 89, 90, 204, 214; 382/169; 358/530, 534

[56] References Cited

U.S. PATENT DOCUMENTS 5,185,602 2/1993 Bassetti, Jr. et al. ..... 345/89
5,187,578 2/1993 Kohgami et al. ..... 348/687
5,293,159 3/1994 Bassetti, Jr. et al. ..... 345/149
5,365,251 11/1994 Denber ..... 345/136
5,475,448 12/1995 Saegusa ..... 348/797
5,497,172 3/1996 Doherty et al. ..... 345/85
5,867,142 2/1999 Thieret ..... 345/136
5,874,932 2/1999 Nagaoka et al. ..... 345/60
5,943,032 8/1999 Nagaoka et al. ..... 345/63

*Primary Examiner*—Richard A. Hjerpe
*Assistant Examiner*—Henry N. Tran
*Attorney, Agent, or Firm*—Arent Fox Kintner Plotkin & Kahn

[57] ABSTRACT

In a self-luminous display, one field of a video signal is divided into a plurality of sub-fields. A plurality of tables stores a plurality of converting pixel data, each of the converting pixel data is different from other converting pixel data in weight in accordance with a luminance level applied thereto. The difference between a pixel data of a selected central pixel in a picture and pixel data of pixels adjacent to the central pixel is detected, and a first select signal when there is a difference, and a second select signal when there is no difference are produced. In response to the first and second select signals, one of the converting pixel data is selected in accordance with distinction of the select signal. A corresponding pixel is driven for a period dependent on the selected converting pixel data.

14 Claims, 18 Drawing Sheets

FIG.6

| LUMINANCE LEVEL | PIXEL DATA 5~0 | FIRST CONVERTING TABLE | SECOND CONVERTING TABLE |
|---|---|---|---|
| | | CONVERTING PIXEL DATA A 7~0 | CONVERTING PIXEL DATA B 7~0 |
| 0 | 000000 | 00000000 | 00000000 |
| 1 | 000001 | 00000100 | 00000100 |
| 2 | 000010 | 00100000 | 00100000 |
| 3 | 000011 | 00100100 | 00100100 |
| 4 | 000100 | 00001000 | 00001000 |
| 5 | 000101 | 00001100 | 00001100 |
| 6 | 000110 | 00101000 | 00101000 |
| 7 | 000111 | 00101100 | 00101100 |
| 8 | 001000 | 00010000 | 00010000 |
| 9 | 001001 | 00010100 | 00010100 |
| 10 | 001010 | 00110000 | 00110000 |
| 11 | 001011 | 00110100 | 00110100 |
| 12 | 001100 | 00011000 | 00011000 |
| 13 | 001101 | 00011100 | 00011100 |
| 14 | 001110 | 00111000 | 00111000 |
| 15 | 001111 | 00111100 | 00111100 |
| 16 | 010000 | 10010000 | 00010001 |
| 17 | 010001 | 10010100 | 00101001 |
| 18 | 010010 | 10110000 | 00110001 |
| 19 | 010011 | 10110100 | 00110101 |
| 20 | 010100 | 10011000 | 00011001 |
| 21 | 010101 | 10011100 | 00011101 |
| 22 | 010110 | 10111000 | 00111001 |
| 23 | 010111 | 10111100 | 00111101 |
| 24 | 011000 | 10010001 | 10010001 |
| 25 | 011001 | 10010101 | 10010101 |
| 26 | 011010 | 10110001 | 10110001 |
| 27 | 011011 | 10110101 | 10110101 |
| 28 | 011100 | 10011001 | 10011001 |
| 29 | 011101 | 10011101 | 10011101 |
| 30 | 011110 | 10111001 | 10111001 |
| 31 | 011111 | 10111101 | 10111101 |

FIG.7

| LUMINANCE LEVEL | PIXEL DATA 5~0 | FIRST CONVERTING TABLE | SECOND CONVERTING TABLE |
|---|---|---|---|
| | | CONVERTING PIXEL DATA A 7~0 | CONVERTING PIXEL DATA B 7~0 |
| 32 | 100000 | 01010001 | 10010010 |
| 33 | 100001 | 01010101 | 10010110 |
| 34 | 100010 | 01110001 | 10110010 |
| 35 | 100011 | 01110101 | 10110110 |
| 36 | 100100 | 01011001 | 10011010 |
| 37 | 100101 | 01011101 | 10011110 |
| 38 | 100110 | 01111001 | 10111010 |
| 39 | 100111 | 01111101 | 10111110 |
| 40 | 101000 | 01010010 | 01010010 |
| 41 | 101001 | 01010110 | 01010110 |
| 42 | 101010 | 01110010 | 01110010 |
| 43 | 101011 | 01110110 | 01110110 |
| 44 | 101100 | 01011010 | 01011010 |
| 45 | 101101 | 01011110 | 01011110 |
| 46 | 101110 | 01111010 | 01111010 |
| 47 | 101111 | 01111110 | 01111110 |
| 48 | 110000 | 11010010 | 01010011 |
| 49 | 110001 | 11010110 | 01010111 |
| 50 | 110010 | 11110010 | 01110011 |
| 51 | 110011 | 11110110 | 01110111 |
| 52 | 110100 | 11011010 | 01011011 |
| 53 | 110101 | 11011110 | 01011111 |
| 54 | 110110 | 11111010 | 01111011 |
| 55 | 110111 | 11111110 | 01111111 |
| 56 | 111000 | 11010011 | 11010011 |
| 57 | 111001 | 11010111 | 11010111 |
| 58 | 111010 | 11110011 | 11110011 |
| 59 | 111011 | 11110111 | 11110111 |
| 60 | 111100 | 11011011 | 11011011 |
| 61 | 111101 | 11011111 | 11011111 |
| 62 | 111110 | 11110111 | 11110111 |
| 63 | 111111 | 11111111 | 11111111 |

FIG.8

| LUMINANCE LEVEL | PIXEL DATA | THIRD CONVERTING TABLE | FOURTH CONVERTING TABLE |
|---|---|---|---|
| | | CONVERTING PIXEL DATA C | CONVERTING PIXEL DATA D |
| | 543210 | 76543210 | 76543210 |
| 0 | 000000 | 00000000 | 00000000 |
| 1 | 000001 | 00000100 | 00000100 |
| 2 | 000010 | 00100000 | 00100000 |
| 3 | 000011 | 00100100 | 00100100 |
| 4 | 000100 | 00001000 | 00001000 |
| 5 | 000101 | 00001100 | 00001100 |
| 6 | 000110 | 00101000 | 00101000 |
| 7 | 000111 | 00101100 | 00101100 |
| 8 | 001000 | 00010000 | 00010000 |
| 9 | 001001 | 00010100 | 00010100 |
| 10 | 001010 | 00110000 | 00110000 |
| 11 | 001011 | 00110100 | 00110100 |
| 12 | 001100 | 00011000 | 00011000 |
| 13 | 001101 | 00011100 | 00011100 |
| 14 | 001110 | 00111000 | 00111000 |
| 15 | 001111 | 00111100 | 00111100 |
| 16 | 010000 | 00010001 | 00010001 |
| 17 | 010001 | 00010101 | 00010101 |
| 18 | 010010 | 00110001 | 00110001 |
| 19 | 010011 | 00110101 | 00110101 |
| 20 | 010100 | 00011001 | 00011001 |
| 21 | 010101 | 00011101 | 00011101 |
| 22 | 010110 | 00111001 | 00111001 |
| 23 | 010111 | 00111101 | 00111101 |
| 24 | 011000 | 10010001 | 10010001 |
| 25 | 011001 | 10010101 | 10010101 |
| 26 | 011010 | 10110001 | 10110001 |
| 27 | 011011 | 10110101 | 10110101 |
| 28 | 011100 | 10011001 | 10011001 |
| 29 | 011101 | 10011101 | 10011101 |
| 30 | 011110 | 10111001 | 10111001 |
| 31 | 011111 | 10111101 | 10111101 |

FIG.9

| LUMINANCE LEVEL | PIXEL DATA | THIRD CONVERTING TABLE | FOURTH CONVERTING TABLE |
|---|---|---|---|
| | | CONVERTING PIXEL DATA C | CONVERTING PIXEL DATA D |
| | 543210 | 76543210 | 76543210 |
| 32 | 100000 | 10010010 | 00010011 |
| 33 | 100001 | 10010110 | 00010111 |
| 34 | 100010 | 10110010 | 00110011 |
| 35 | 100011 | 10110110 | 00110111 |
| 36 | 100100 | 10011010 | 00011011 |
| 37 | 100101 | 10011110 | 00011111 |
| 38 | 100110 | 10111010 | 00111011 |
| 39 | 100111 | 10111110 | 00111111 |
| 40 | 101000 | 01010010 | 01010010 |
| 41 | 101001 | 01010110 | 01010110 |
| 42 | 101010 | 01110010 | 01110010 |
| 43 | 101011 | 01110110 | 01110110 |
| 44 | 101100 | 01011010 | 01011010 |
| 45 | 101101 | 01011110 | 01011110 |
| 46 | 101110 | 01111010 | 01111010 |
| 47 | 101111 | 01111110 | 01111110 |
| 48 | 110000 | 11010010 | 01010011 |
| 49 | 110001 | 11010110 | 01010111 |
| 50 | 110010 | 11110010 | 01110011 |
| 51 | 110011 | 11110110 | 01110111 |
| 52 | 110100 | 11011010 | 01011011 |
| 53 | 110101 | 11011110 | 01011111 |
| 54 | 110110 | 11111010 | 01111011 |
| 55 | 110111 | 11111110 | 01111111 |
| 56 | 111000 | 11010011 | 11010011 |
| 57 | 111001 | 11010111 | 11010111 |
| 58 | 111010 | 11110011 | 11110011 |
| 59 | 111011 | 11110111 | 11110111 |
| 60 | 111100 | 11011011 | 11011011 |
| 61 | 111101 | 11011111 | 11011111 |
| 62 | 111110 | 11111011 | 11111011 |
| 63 | 111111 | 11111111 | 11111111 |

FIG.10

| | 1 | 2 | 3 | 4 | 5 | 6 | 7 | 8 | 9 | 10 |
|---|---|---|---|---|---|---|---|---|---|---|
| 1 | 31 | 31 | 31 | 31 | 31 | 31 | 32 | 32 | 32 | 32 |
| 2 | 31 | 31 | 31 | 31 | 31 | 32 | 32 | 32 | 32 | 32 |
| 3 | 31 | 31 | 31 | 31 | 32 | 32 | 32 | 32 | 32 | 32 |
| 4 | 31 | 31 | 31 | 31 | 32 | 32 | 32 | 32 | 32 | 32 |
| 5 | 31 | 31 | 31 | 31 | 32 | 32 | 32 | 32 | 32 | 32 |
| 6 | 31 | 31 | 31 | 31 | 32 | 32 | 32 | 32 | 32 | 32 |
| 7 | 31 | 31 | 31 | 31 | 31 | 32 | 32 | 32 | 32 | 32 |
| 8 | 31 | 31 | 31 | 31 | 31 | 31 | 32 | 32 | 32 | 32 |
| 9 | 31 | 31 | 31 | 31 | 31 | 31 | 32 | 32 | 32 | 32 |

(COLUMN)

(ROW)

FIG.11

| | 1 | 2 | 3 | 4 | 5 | 6 | 7 | 8 | 9 |
|---|---|---|---|---|---|---|---|---|---|
| 1 | C | C | C | C | A | B | A | C | C |
| 2 | C | C | C | A | B | A | B | C | C |
| 3 | C | C | C | B | A | B | C | C | C |
| 4 | C | C | C | A | B | C | C | C | C |
| 5 | C | C | C | B | A | C | C | C | C |
| 6 | C | C | C | A | B | A | C | C | C |
| 7 | C | C | C | B | A | B | A | C | C |
| 8 | C | C | C | C | B | A | B | C | C |
| 9 | C | C | C | C | C | B | A | C | C |

(COLUMN)

(ROW)

FIG.12

| | 1 | 2 | 3 | 4 | 5 | 6 | 7 | 8 | 9 |
|---|---|---|---|---|---|---|---|---|---|
| 1 | C | D | C | D | A | B | A | C | D |
| 2 | D | C | D | A | B | A | B | D | C |
| 3 | C | D | C | B | A | B | D | C | D |
| 4 | D | C | D | A | B | D | C | D | C |
| 5 | C | D | C | B | A | C | D | C | D |
| 6 | D | C | D | A | B | A | C | D | C |
| 7 | C | D | C | B | A | B | D | C | D |
| 8 | D | C | D | C | B | A | B | D | C |
| 9 | C | D | C | D | C | B | D | C | D |

(COLUMN)

(ROW)

FIG.13

| | 1 | 2 | 3 | 4 | 5 | 6 | 7 | 8 | 9 |
|---|---|---|---|---|---|---|---|---|---|
| 1 | A | A | A | A | A | B | A | A | A |
| 2 | A | A | A | A | B | A | B | A | A |
| 3 | A | A | A | B | A | B | A | A | A |
| 4 | A | A | A | A | B | A | A | A | A |
| 5 | A | A | A | B | A | A | A | A | A |
| 6 | A | A | A | A | B | A | A | A | A |
| 7 | A | A | A | B | A | B | A | A | A |
| 8 | A | A | A | A | B | A | B | A | A |
| 9 | A | A | A | A | A | B | A | A | A |

(COLUMN)

(ROW)

FIG.14

| | 1 | 2 | 3 | 4 | 5 | 6 | 7 | 8 | 9 |
|---|---|---|---|---|---|---|---|---|---|
| 1 | B | B | B | B | A | B | A | B | B |
| 2 | B | B | B | A | B | A | B | B | B |
| 3 | B | B | B | B | A | B | B | B | B |
| 4 | B | B | B | A | B | B | B | B | B |
| 5 | B | B | B | B | A | B | B | B | B |
| 6 | B | B | B | A | B | A | B | B | B |
| 7 | B | B | B | B | A | B | A | B | B |
| 8 | B | B | B | B | B | A | B | B | B |
| 9 | B | B | B | B | B | B | A | B | B |

(COLUMN)

(ROW)

DRIVING SYSTEM FOR A SELF-LUMINOUS DISPLAY

BACKGROUND OF THE INVENTION

The present invention relates to a driving system for driving a self-luminous display.

There has been known a method for displaying an image on a plasma display panel as a self-luminous display by controlling a tone of the image. In the method, each field of a video signal is divided into N pieces of sub-fields, and each sub-field emits the light for a time length corresponding to a weight applied to each bit of N-bit pixel data.

If a pixel data for each pixel has 8 bits, each field is divided into eight sub-fields, SF8, SF7, SF6, . . . , SF1 in descending order of weight from the first to the eighth. The time length of each sub-field is determined in accordance with its weight. The sub-fields SF8 to SF1 emit the light by 128 pulses, 64 pulses, 32 pulses, 16 pulses, 8 pulses, 4 pulses, 2 pulses and 1 pulse, respectively, in order. Thus, the tone of 256 steps can be obtained by combining the eight sub-fields.

For example, if a pixel data applied to a pixel is "10000000" (light emitting pattern), only the sub-field SF8 emits light in a field. During the sub-field SF8, the light is emitted by 128 pulses, thereby obtaining a display having the tone of 128 levels.

Furthermore, if the pixel data is "10100000", the sub-fields SF8 and SF6 emit light in the field. During the sub-fields SF8 and SF6, the light is emitted by 128 and 32 pulses, thereby obtaining a display having the tone of 160 (128+32) levels.

In such a method, the sub-fields SF8 to SF1 start emitting the light in a fixed order, from the sub-field having the longest time length, or from the sub-field having the shortest time length.

However, when the tone level is decreased from 128 to 127, namely, the pixel data changes from "10000000" to "01111111", false contours of stripes are recognized as if the tone of the image is lost, in spite of gradual change of luminance and tone. Therefore, a problem that the quality of display is extremely deteriorated arises. Namely, when the pixel data changes from "10000000" to "01111111", the emission of light does not occur for a period between the sub-field SF7 of the first field and the sub-field SF8 of the second field. Therefore, the luminance momentarily reduces.

Japanese Patent Application Laid-Open No. 7-271325 discloses a method for display an image by controlling a tone. In order to restrain reduction of the quality of display, a sub-field having a large weight is further divided into a plurality of parts, and these parts are separately disposed in a field.

FIG. 17 shows a light emitting format in the field disclosed in the method. The field is divided into six sub-fields, SF6 to SF1 having the ratio of weights 32:16:8:4:2:1 in order. The heaviest sub-field SF6 is divided into short sub-fields $SF6_1$ and $SF6_2$ each of which has the ratio of weight 16. Furthermore, the second heavier sub-field SF5 is divided into short sub-fields $SF5_1$ and $SF5_2$ each of which has the ratio of weight 8. Thus, in the field, three sub-fields SF4, $SF5_1$ and $SF5_2$ of the ratio of weight 8 and two sub-fields $SF6_1$ and $SF6_2$ of the ratio of weight 16 are provided.

Here, the pixel data for each pixel is converted into a light emitting pattern shown in FIG. 17. The pixel data having the level of 32nd of luminance and tone is converted into one of the patterns as follows.

"01010001": light emitting pattern A

"10010010": light emitting pattern B

FIG. 18*a* shows a field having the light emitting pattern A where the light is emitted only during the short sub-fields $SF6_1$, SF4 and $SF5_2$. The light is not emitted during the other sub-fields (hatched areas). On the other hand, FIG. 18*b* shows a field having the light emitting pattern B where the light is emitted only during the sub-fields $SF5_1$, SF4 and $SF6_2$.

During both of the fields, although the light is emitted to obtain the tone level of 32nd, the timings for emitting the light differ.

In the method, the light is emitted by the light emitting patterns A and B which are alternately performed every pixel on the display.

Therefore, when the pixel data changes from "10000000" to "01111111", namely, at a border where a figure of the high-figure bit of the pixel data is down, sequential non-light emitting period as aforementioned does not occur. Thus, the false contour is reduced when the image is moved on the display.

However in such a method, when watching a moving image on the display, a further problem of trouble in that dark and bright stripes may appear on the display arise.

FIG. 19 shows an image having the tone level of 32nd for explaining the trouble in which the image moves from an upper portion to a lower portion of a picture. G11 to G81 are pixels shown in FIG. 18 only from the first row to the eighth row on the first column in the picture. The field of each pixel has the format shown in FIG. 17. Each of the pixels G11, G31, G51 and G71 on odd rows has the field emitted by the light emitting pattern A shown in FIG. 18*a*. Each of the pixels G21, G41, G61 and G81 on even rows has the field emitted by the light emitting pattern B shown in FIG. 18*b*.

As shown in FIG. 19, if a viewer moves his eyes as shown by an arrow S1 together with the image having the tone level of 32nd, a dark stripe having a lower tone level than that of 32nd is recognized. Namely, the non-light emitting period is recognized longer than the light emitting period because of the timing of the arrow S1.

To the contrary, if the viewer moves his eyes as shown by an arrow S2, a bright stripe is recognized. Namely, the light emitting period is recognized longer than the non-light emitting period because of the timing of the arrow S2.

SUMMARY OF THE INVENTION

An object of the present invention is to provide a driving system for a self-luminous display in which false contour and defect of the picture of the display can be prevented.

According to the present invention, there is provided a driving system for a self-luminous display, wherein one field of a video signal is divided into a plurality of sub-fields, each of the sub-field is different from other sub-field in weight, in which at least one of heavily weighted sub-fields is divided into a plurality of short sub-fields, the system comprising a plurality of tables, each of the tables storing a plurality of converting pixel data, each of the converting pixel data being different from other converting pixel data in weight in accordance with a luminance level applied thereto, detector means for detecting difference between a pixel data of a selected central pixel in a picture and pixel data of pixels adjacent to the central pixel in logical value at heavier bits of a pixel data, and producing a first select signal when there is a difference, and a second select signal when there is no difference, select means responsive to the first and second select signals for selecting one of the converting pixel data which is different in table in accordance with distinction of the select signal, a frame memory for storing a selected converting pixel data, and driving means for driving a corresponding pixel for a period dependent on the selected converting pixel data derived from the frame memory.

The converting pixel data includes a first converting pixel data, a second converting pixel data and a third converting pixel data.

The detector means comprises a comparator for comparing a pixel data of one of adjacent pixels with a pixel data of a selected central pixel at a most significant bit, and producing the first select signal of a logic level "1".

The detector means produces the first select signal when even one of adjacent pixels differs from the central pixel in pixel data.

Each of the converting pixel data is different in light emitting timing from other converting pixel data in accordance with a luminance level applied thereto.

The first converting pixel data or the second converting pixel data is selected when the first select signal is produced.

The present invention further provides a method for driving a self-luminous display, wherein one field of a video signal is divided into a plurality of sub-fields, each of the sub-field is different from other sub-field in weight, in which at least one of heavily weighted sub-fields is divided into a plurality of short sub-fields, the steps comprising storing a plurality kinds of converting pixel data in corresponding tables, each kind of the converting pixel data being different from other kinds of converting pixel data in weight in accordance with a luminance level applied thereto, detecting difference between a pixel data of a selected central pixel in a picture and pixel data of pixels adjacent to the central pixel in logical value at heavier bits of a pixel data, and producing a first select signal when there is a difference, and a second select signal when there is no difference, selecting one of the converting pixel data in accordance with distinction of the select signal, storing a selected converting pixel data in a frame memory, and driving a corresponding pixel for a period dependent on the selected converting pixel data derived from the frame memory.

These and other objects and features of the present invention will become more apparent from the following detailed description with reference to the accompanying drawings.

BRIEF DESCRIPTION OF DRAWINGS

FIGS. 6 and 7 show first and second tables of correcting data for the pixel provided in the false contour correcting circuit;

FIGS. 8 and 9 show third and fourth tables of correcting data for the pixel provided in the false contour correcting circuit;

FIG. 10 shows a matrix of pixels represented by levels of luminance for explaining operation of the false contour correcting circuit;

FIG. 11 shows a matrix of pixels represented by correcting data for explaining operation of the false contour correcting circuit;

FIGS. 13 and 14 show further modifications of the matrix of pixels of FIG. 12;

DETAILED DESCRIPTION OF THE PREFERRED EMBODIMENTS

Figure 1:
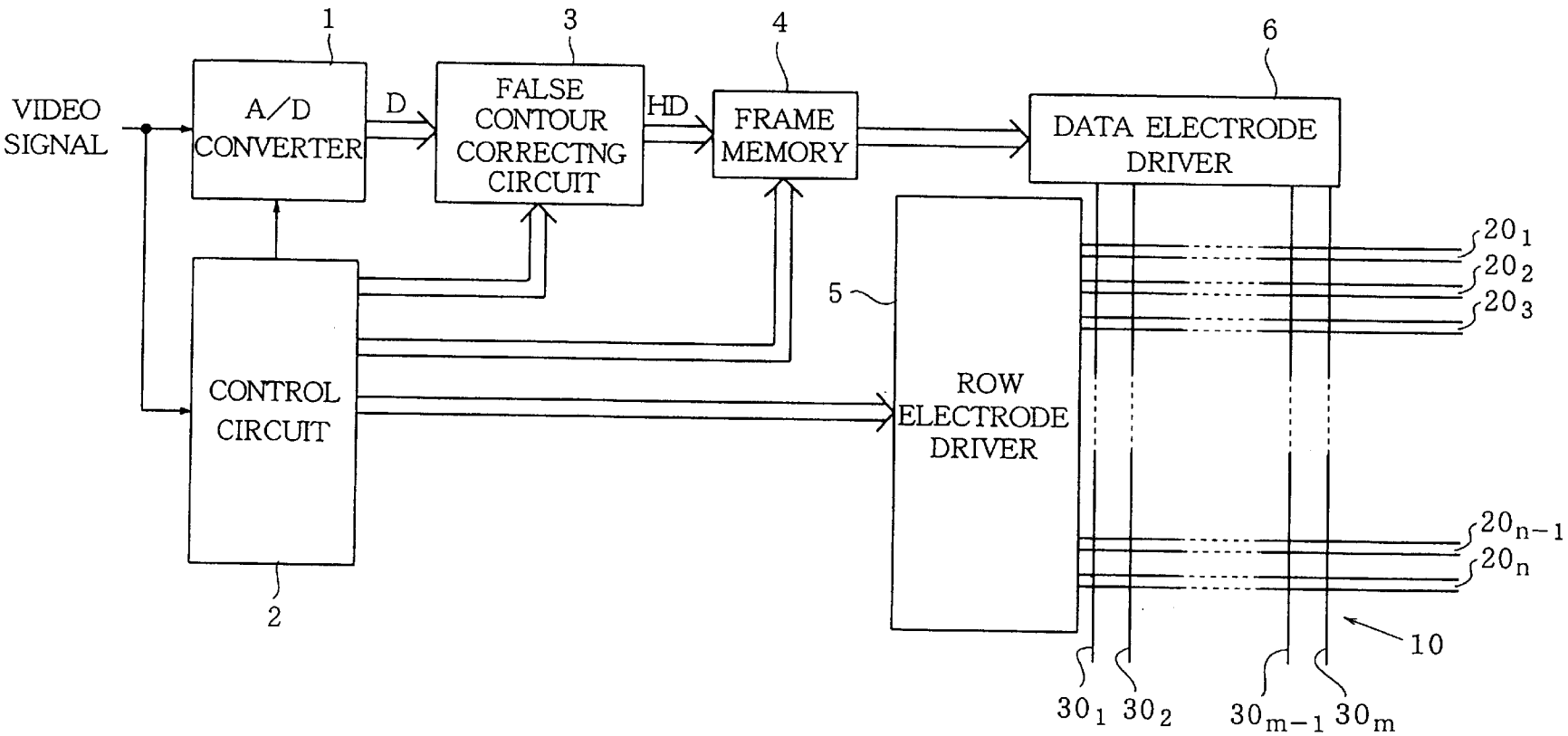
FIG. 1 is a block diagram showing a plasma display having a driving system according to the present invention.

Referring to FIG. 1 showing a plasma display system of the present invention, the system comprises a control circuit 2 applied with a video signal for extracting horizontal and vertical synchronizing signals. The control circuit 2 produces a sampling clock signal, and various timing signals for generating reset, scanning, sustaining and erasing signals corresponding to the horizontal and vertical synchronizing signals. The sampling clock signal is applied to an A/D converter 1. The horizontal and vertical synchronizing signals are applied to a false contouring correcting circuit 3. The timing signals are applied to a frame memory 4 and a row electrode driver 5.

The A/D converter 1 is further applied with the video signal and operated for sampling the input video signal to obtain a pixel data D of N-bit for each pixel corresponding to the sampling clock signal from the control circuit 2. The pixel data D is applied to the false contour correcting circuit 3.

The false contour correcting circuit 3 is operated to correct a false contour of the pixel data D and produces a correcting pixel data HD which is applied to the frame memory 4.

The frame memory 4 is operated to store the correcting pixel data HD in order based on the timing signal from the control circuit 2, and to read the correcting pixel data HD stored therein when one frame is written. The read correcting pixel data HD is applied to a pixel data electrode driver 6 as a pixel data driving data.

The row electrode driver 5 is connected to each pair of row electrodes $\mathbf{20}_1$, $\mathbf{20}_2$, $\mathbf{20}_3$, . . . $\mathbf{20}n$ of a plasma display panel (PDP) 10. The row electrode driver 5 produces a reset pulses for initializing residual charge, a scanning pulse for writing the pixel data, a sustaining pulse for sustaining the discharge and emission of light, and an erasing pulse for stopping the discharge and emission of light corresponding to the timing pulses from the control circuit 2. These pulses are applied to the row electrodes $\mathbf{20}_1$–$\mathbf{20}_n$ of the PDP 10 at the respective timings.

The pixel data electrode driver 6 is connected to pixel data electrodes $\mathbf{30}_1$, $\mathbf{30}_2$, $\mathbf{30}_3$, . . . $\mathbf{30}m-1$, and $\mathbf{30}m$ of the PDP 10. The pixel data electrode driver 6 operates to separate the pixel data driving data at every bit having the same weight, and produces a pixel data pulse having voltage corresponding to the logic value "1" or "0" of each bit. The pixel data pulse is applied to the pixel data electrodes $\mathbf{30}_1$–$\mathbf{30}_m$ of the PDP 10.

Figure 2:
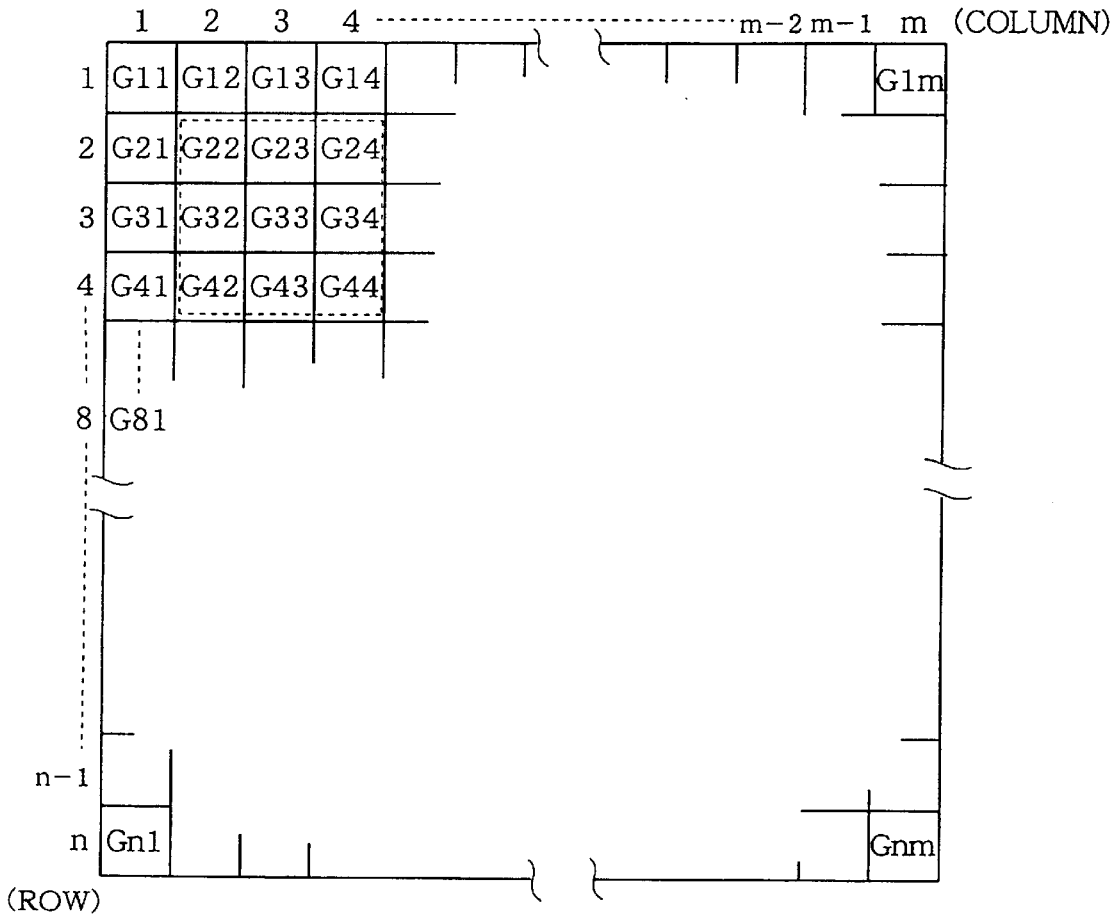
FIG. 2 is a schematic diagram showing a matrix of pixels of the plasma display.

In operation of the PDP 10, during the pixel data electrode driver 6 applies the pixel data pulse to the pixel data electrodes, the row electrode driver 5 applies the scanning pulse to the row electrodes. Thus, charge corresponding to the pixel data pulse is written on the PDP 10. When the logic value of the pixel data pulse is "1", the light is emitted at the intersection of the data electrode and the row electrode. FIG. 2 shows pixels $G_{11}$ to Gnm of the display formed on the intersections.

Figure 17:
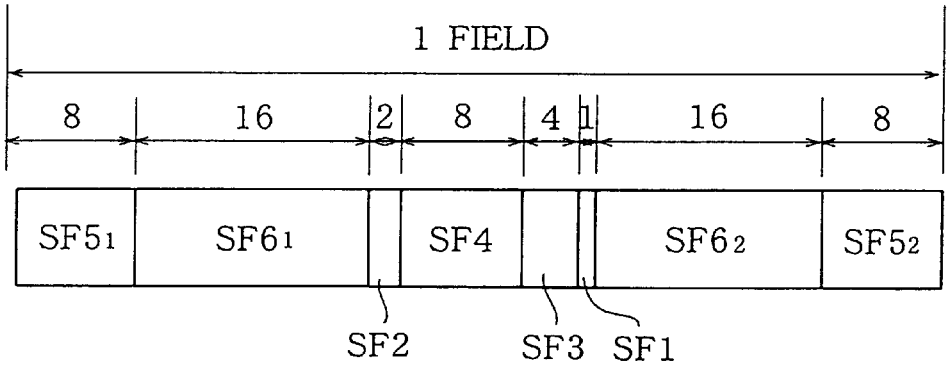
FIG.17 PRIOR ART
FIG. 17 is diagram showing a light emitting format for one field of a conventional display.
Figure 18:
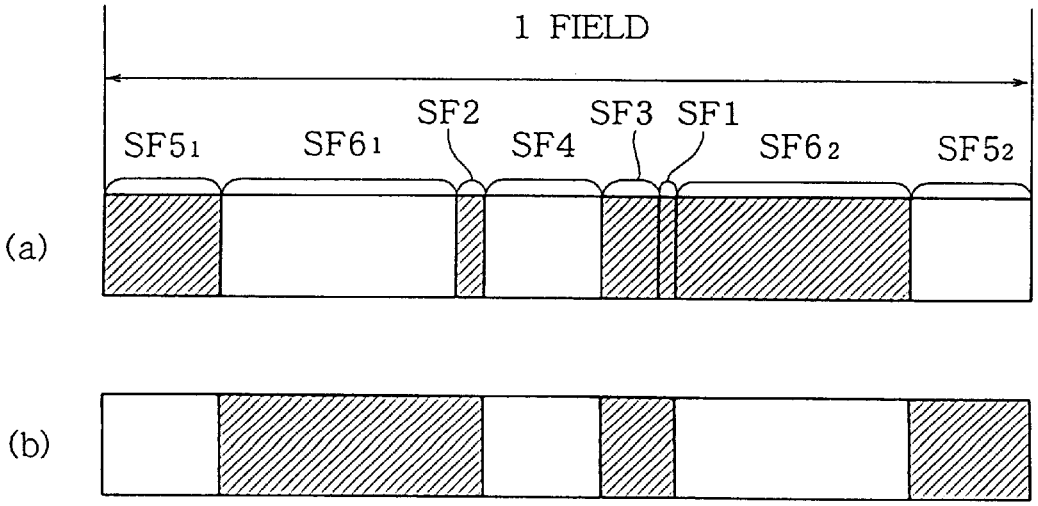
FIG.18 PRIOR ART
FIGS. 18*a* and 18*b* are diagram showing light emitting operations of the conventional system.
Figure 19:
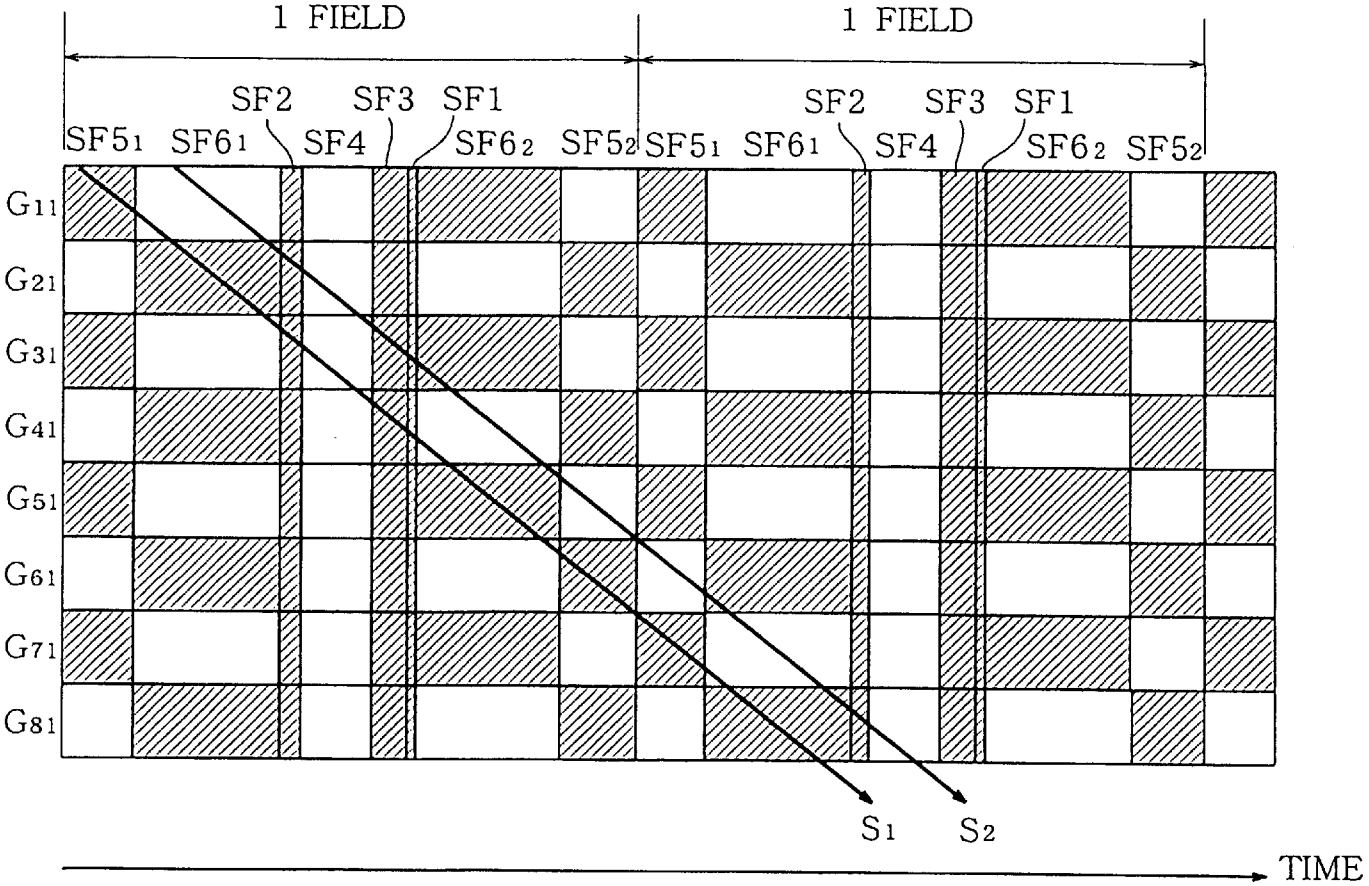
FIG.19 PRIOR ART
FIG. 19 is a diagram showing sequential fields for forming an image for explaining the false contour of the conventional system.

When the row electrode driver 5 applies the sustaining pulse to the row electrodes, the pixel at the intersection sustains the discharge and emission of light for the period corresponding to the number of pulses which the sustaining pulses are applied. The luminance is visually recognized corresponding to the total of the light emitting period of the sub-fields shown in FIG. 17.

Figure 3:
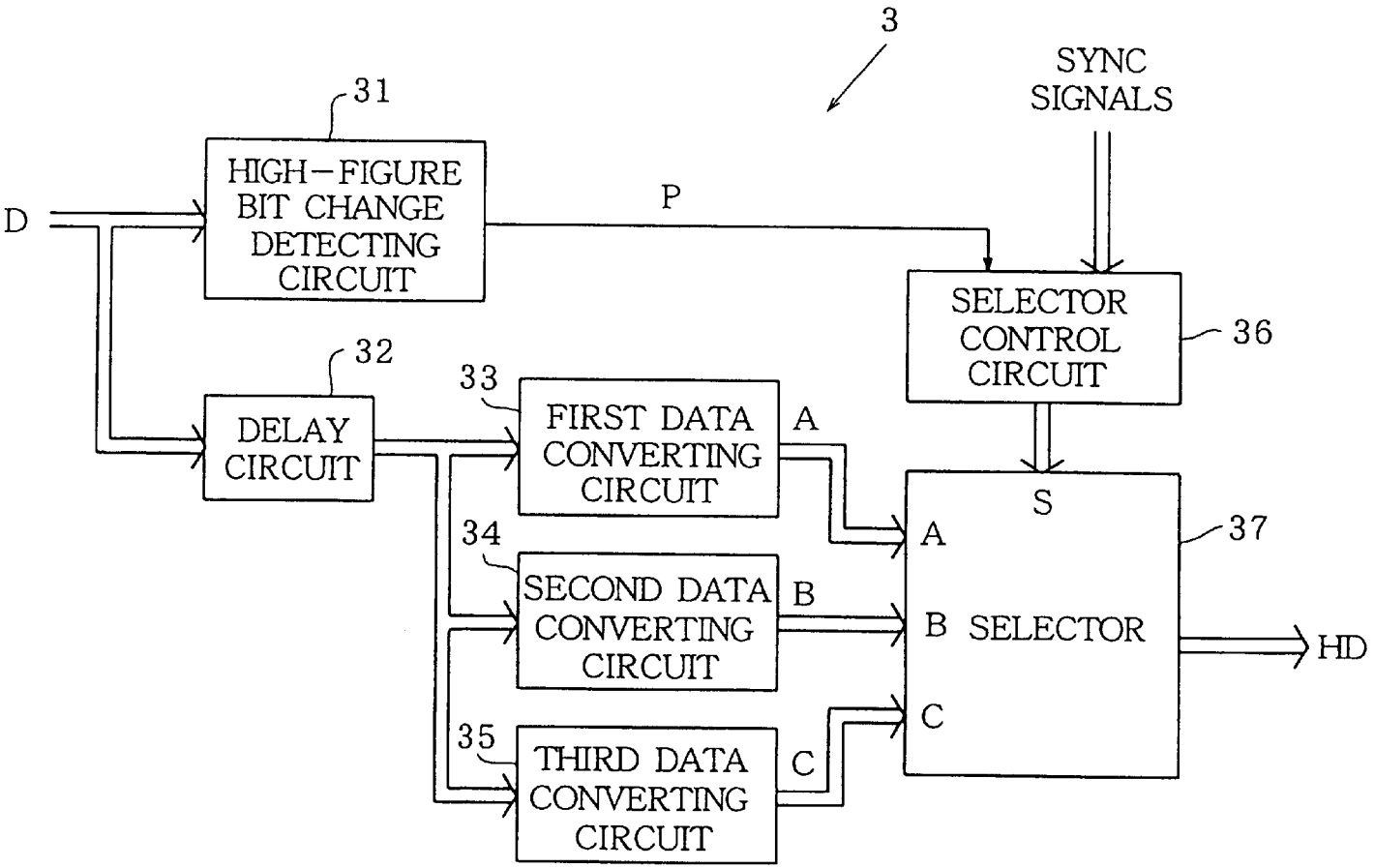
FIG. 3 is a block diagram showing a false contour correcting circuit provided in the driving system.

FIG. 3 shows the false contour correcting circuit 3. The false contour correcting circuit 3 comprises a high-figure bit change detecting circuit 31, a selector control circuit 36, a delay circuit 32, first, second and third data converting circuits 33, 34 and 35, and a selector 37.

The high-figure bit change detecting circuit 31 is applied with the pixel data D for detecting the change of the high-figure bit of the data at a next field. The pixel data D is a data of 6-bit from the fifth bit of most significant bit (MSB) to the zeroth bit, and the change of the high-figure three bits of each pixel data is detected.

Figure 4:
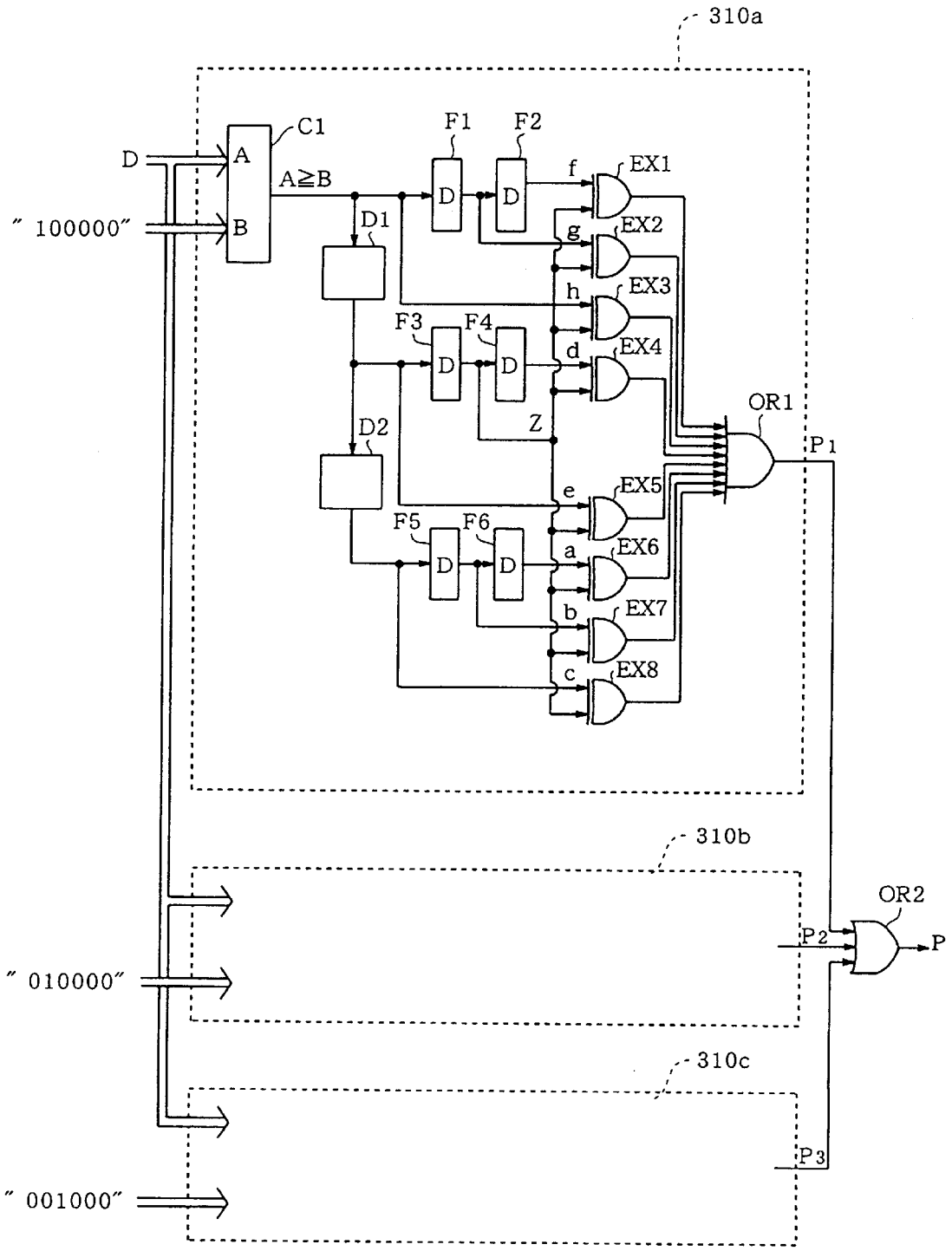
FIG. 4 is a block diagram showing a high-figure bit change detecting circuit provided in the false contour correcting circuit.

FIG. 4 shows the high-figure bit change detecting circuit 31. The high-figure bit change detecting circuit 31 has three circuits 310*a*, 310*b* and 310*c* for detecting the high-figure three bits of the data. Each circuit has the same structure as others.

The circuit 310*a* comprises a comparator C1, a pair of delay circuits D1 and D2 connected to the comparator C1 in series, six flip-flops F1 to F6, eight exclusive OR gates EX1 to EX8, and an OR gate OR1.

The comparator C1 is applied with the pixel data D. In this embodiment, the pixel data D is represented by six bits. Therefore, luminance levels of 63 are provided. The comparator C1 compares a luminance level of a central pixel z (FIG. 5) with luminance levels of pixels (a–h) surrounding the central pixel z at the most significant bit (MSB)(5th bit). For example, when the luminance level of the central pixel is 32, the data "100000" of the luminance level of 32nd is compared with data of adjacent pixel. If the pixel data D is not "100000", the comparator C1 produces a comparison signal of the logic value "1". If the pixel data is equal to "100000", a comparison signal of the logic value "0" is produced.

Each of the delay circuits D1 and D2 produces a signal with a delay corresponding to a horizontal scanning period at which the pixel data applied to the pixels of the first column to the m column on a row shown in FIG. 2. Each of the flip-flops F1 to F6 produces a signal with a delay corresponding to a sampling period of the pixel data.

Figure 5:
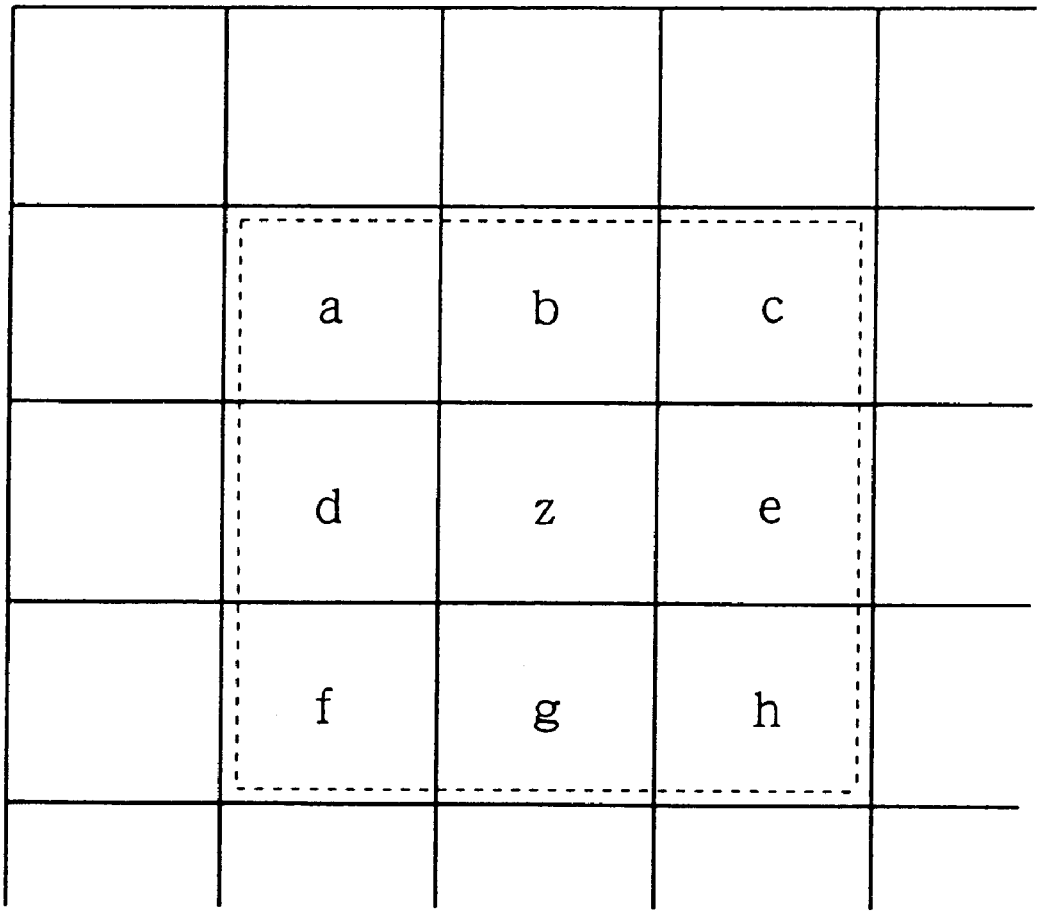
FIG. 5 shows a matrix of pixels for explaining positions of a pixel z and adjacent pixel a–h.

The comparison signal of the comparator C1 is applied to the delay circuits D1 and D2 and the flip-flops F1 to F6. The comparison signal is further applied to the exclusive OR gate EX3 as a comparison signal h corresponding to the pixel h in a three by three matrix as shown in FIG. 5. The delay circuits D1 and D2 and the flip-flops F1 to F6 produce comparison signals a–g and z corresponding to pixels a–g and z shown in FIG. 5. These signals a–g are applied to the exclusive OR gates EX1 and EX2, and EX4 to EX8, respectively. The signal Z from the flip-flop F3 is applied to all of the exclusive OR gates EX1 to EX8 for comparing the signal z with the signals a–h, respectively.

In the exclusive OR gates EX1 to EX8, if two input signals have the same logic value, the gates produce output signals of the logic value "0" which are applied to the OR gate OR1. If all of the input signals have the same logic value, the OR gate OR1 produces a detection signal P1 of the logic value "0". If any one of the input signals differs, a detection signal P1 having the logic value "1" is produced.

On the other hand, in the comparator C1 of the circuit 310*b*, the fifth and fourth bits of the pixel data D are compared, for example, with the data "010000". A detection signal P2 is obtained in the same manner as the circuit 310*a*.

Furthermore, in the comparator C1 of the circuit 310*c*, the fifth, fourth and third bits of the pixel data D are compared, for example, with the data "001000". A detection signal P3 is obtained in the same manner as the circuit 310*a*.

The detection signals P1, P2 and P3 are applied to an OR gate OR2. If any one of the detection signals is at "1", the OR gate OR2 produces a detection signal P of the logic value "1" which means that the bit is changed. The detection signal P is applied to the selector control circuit 36 of FIG. 3.

Referring back to FIG. 3, the delay circuit 32 is applied with the pixel data D and produces a signal with a delay corresponding to a timing at which the high-figure bit change detecting circuit 31 applies the detection signal P to the control circuit 36. The timing is the same as the total delay of the delay circuit D1 and the flip-flop F3.

The delayed signal is selectively applied to a first data converting circuit 33, a second data converting circuit 34, or a third data converting circuit 34.

The first data converting circuit 33 converts the pixel data of 6 bits to a converting pixel data A of 8 bits of the corresponding luminance level in accordance with a first converting table as shown in FIGS. 6 and 7. The converting pixel data A is applied to the selector 37.

Similarly, the second data converting circuit 34 converts the pixel data of 6 bits to a converting pixel data B of 8 bits of the corresponding luminance level in accordance with a second converting table of FIGS. 6 and 7. The converting pixel data B is applied to the selector 37.

The third data converting circuit 35 converts the pixel data of 6 bits to a converting pixel data C of 8 bits of the corresponding luminance level in accordance with a third converting table as shown in FIGS. 8 and 9. The converting pixel data C is applied to the selector 37.

When the detection signal P applied to the control circuit 36 is "1", which means that at least one of the high-figure bits of the pixel data changes, the control circuit 36 applies a control signal to the selector 37 where one of the converting pixel data A and B from the first and second converting circuits 33 and 34 is selected.

When the detection signal P is "0", since the high-figure bits do not change, the control circuit 36 applies a control signal to the selector 37 for selecting the converting pixel data C from the third converting circuit 35.

If the detection signal P is "1", the control circuit 36 controls the selector 37 to alternately select the converting pixel data A or B at every sampling clock signal.

The selector 37 selects one of the converting pixel data A, B and C corresponding to the control signal from the control circuit 36 and produces the selected signal as a correcting pixel data HD.

The operation of the false contour correcting circuit 3 will be described with reference to FIGS. 10 and 11.

FIG. 10 shows a nine by ten matrix of the pixels each of which is indicated by the luminance level of the pixel data D applied to the pixel. As an example, the pixels on the left side at a borderline are applied with the pixel data corresponding to the luminance level of 31st, and the pixels on the right side at the borderline are applied with the pixel data corresponding to the luminance level of 32nd. The fifth bit of each pixel data changes at the borderline.

The operation will be described with the area surrounded by the dashed line, namely second to tenth columns of the second row.

First, a pixel data applied to a pixel in the second column of the second row having the luminance level of 31st is compared with those applied to eight adjacent pixels (a–h of FIG. 5). The pixel data of each adjacent pixel has the same luminance level of 31st as the pixel data of the second column of the second row. Thus, the high-figure bit detecting circuit 31 detects that the bit does not change, and produces the detection signal P of the logic value "0" which is applied to the control circuit 36. The control circuit 36 applies the control signal to the selector 37 for selecting the converting pixel data C from the third data converting circuit 35. The selector 37 produces the converting pixel data C as the correcting pixel data HD which is written in the frame memory 4 at a position of the second column of the second row as shown in FIG. 11.

Next, a pixel data applied to a pixel in the third column of the second row having the luminance level of 31st is compared with those applied to eight adjacent pixels. The pixel data of each adjacent pixel has the same luminance level of 31st as the pixel data of the third column. Thus, as aforementioned, the high-figure bit detecting circuit 31 applies the detection signal P of the logic value "0" to the control circuit 36. The selector 37 selects the converting pixel data C from the third circuit 35 which is written in the frame memory 4 at the third column of the second row as shown in FIG. 11 as the correcting pixel data HD.

A pixel data applied to a pixel in the fourth column of the second row having the luminance level of 31st is compared with those applied to eight adjacent pixels. The pixel data of the pixel in the fifth column of the third row which has the luminance level of 32nd. It means that the fifth bit of the pixel data in the fifth column of the third row is changed. Thus, the high-figure bit detecting circuit 31 detects that the bit is changed, and produces the detection signal P of the logic value "11" which is applied to the control circuit 36. The selector 37 selects the converting pixel data A from the first data converting circuit 33 as shown in FIG. 11 as the correcting pixel data HD.

Then, a pixel data applied to a pixel in the fifth column of the second row having the luminance level of 31st is compared with those applied to eight adjacent pixels. The pixel data of the pixels in the sixth column of the second row and the fifth and sixth columns of the third row have the luminance level of 32nd. It means that the fifth bits of these pixel are changed. Thus, the high-figure bit detecting circuit 31 applies the detection signal P of the logic value "1" to the control circuit 36. Thus, the selector 37 selects the converting pixel data B from the second data converting circuit 34 as shown in FIG. 11 as the correcting pixel data HD.

Next, a pixel data applied to a pixel in the sixth column of the second row having the luminance level of 32nd is compared with those applied to eight adjacent pixels. The pixel data of the pixels in the fifth column of the second row and the fifth and sixth columns of the first row have the luminance level of 31st. Since the fifth bits of these pixel are changed, the high-figure bit detecting circuit 31 applies the detection signal P of the logic value "1" to the control circuit 36. Thus, the selector 37 selects the converting pixel data A from the first data converting circuit 33 as shown in FIG. 11 as the correcting pixel data HD.

A pixel data applied to a pixel in the seventh column of the second row having the luminance level of 32nd is compared with those applied to eight adjacent pixels. The pixel data of the pixel in the sixth column of the first row has the luminance level of 31st. Thus, the high-figure bit detecting circuit 31 applies the detection signal P of the logic value "1" to the control circuit 36. The selector 37 selects the converting pixel data B from the second data converting circuit 34 as shown in FIG. 11 as the correcting pixel data HD.

Furthermore, a pixel data applied to a pixel in the eighth column of the second row having the luminance level of 32nd is compared with those applied to eight adjacent pixels. The pixel data of each adjacent pixel has the same luminance level of 32nd as the pixel data of the eighth column. Thus, the high-figure bit detecting circuit 31 applies the detection signal P of the logic value "0" to the control circuit 36. The selector 37 selects the converting pixel data C from the third data converting circuit 35 as shown in FIG. 11 as the correcting pixel data HD.

Finally, a pixel data applied to a pixel in the ninth column of the second row having the luminance level of 32nd is compared with those applied to eight adjacent pixels. The pixel data of each adjacent pixel has the same luminance level of 32nd as the pixel data of the ninth column. Thus, the high-figure bit detecting circuit 31 applies the detection signal P of the logic value "0" to the control circuit 36. The selector 37 selects the converting pixel data C from the third circuit 35 as shown in FIG. 11 as the correcting pixel data HD.

Here, the logic value "1" of each bit of the converting pixel data A to C indicates the emission of light, and the logic value "0" indicates the non-emission of light. The light emitting period and figure position of each sub-field in the eight figures are formed in accordance with the format of the light emitting period and the order shown in FIG. 17. Namely, the weight of each sub-field which is dependent on the light emittting period, and the figure position of the sub-field in one field are the same as FIG. 17.

From the foregoing, in the embodiment, the tone is controlled by the light emitting pattern based on the pixel data for each pixel. If the logic value of the high-figure bit of the pixel data is different from at least one of that of each of the eight adjacent pixel data, the light emitting pattern of the converting pixel data C is changed to the other light emitting pattern of converting pixel data A or B, thereby reducing the false contour.

Consequently, since the light emitting pattern does not change in the area where the high-figure bit of the pixel data does not change, the false contour is not recognized by the viewer even if the image is moved on the display.

It will be noted from FIG. 11 that data A and B are selected so as not to adjoin each other.

FIG. 12 shows another example of the nine by nine matrix of pixels of FIG. 11 employed with a converting pixel data D in a fourth table shown in FIGS. 8 and 9.

In FIG. 11, the converting pixel data C of the third converting table of FIGS. 8 and 9 are applied to the pixels in the area where the high-figure bits of the pixels do not change.

However, as shown in FIG. 12, the converting pixel data C may be substituted with the converting pixel data D in the fourth table. The converting pixel data D is operated to fix the highest figure bit of the logic value "1". In the example, the influence of the false contour is restrained.

FIGS. 13 and 14 show further examples of FIG. 11 where only converting pixel data A and B are applied to the pixels in the area where the high-figure bits of the pixels do not change. In these examples, one of the converting pixel data A and B is used to be fixed.

Alternatively, the pixel corresponding to the pixel z shown in FIG. 5 may be compared with four adjacent pixels disposed above, below, right and left thereof such as pixels b, g, d and e of FIG. 5. Furthermore, the pixel z may be compared with adjacent pixels in the five by five matrix (24 pixels) including eight adjacent pixels a–h.

Figure 15:
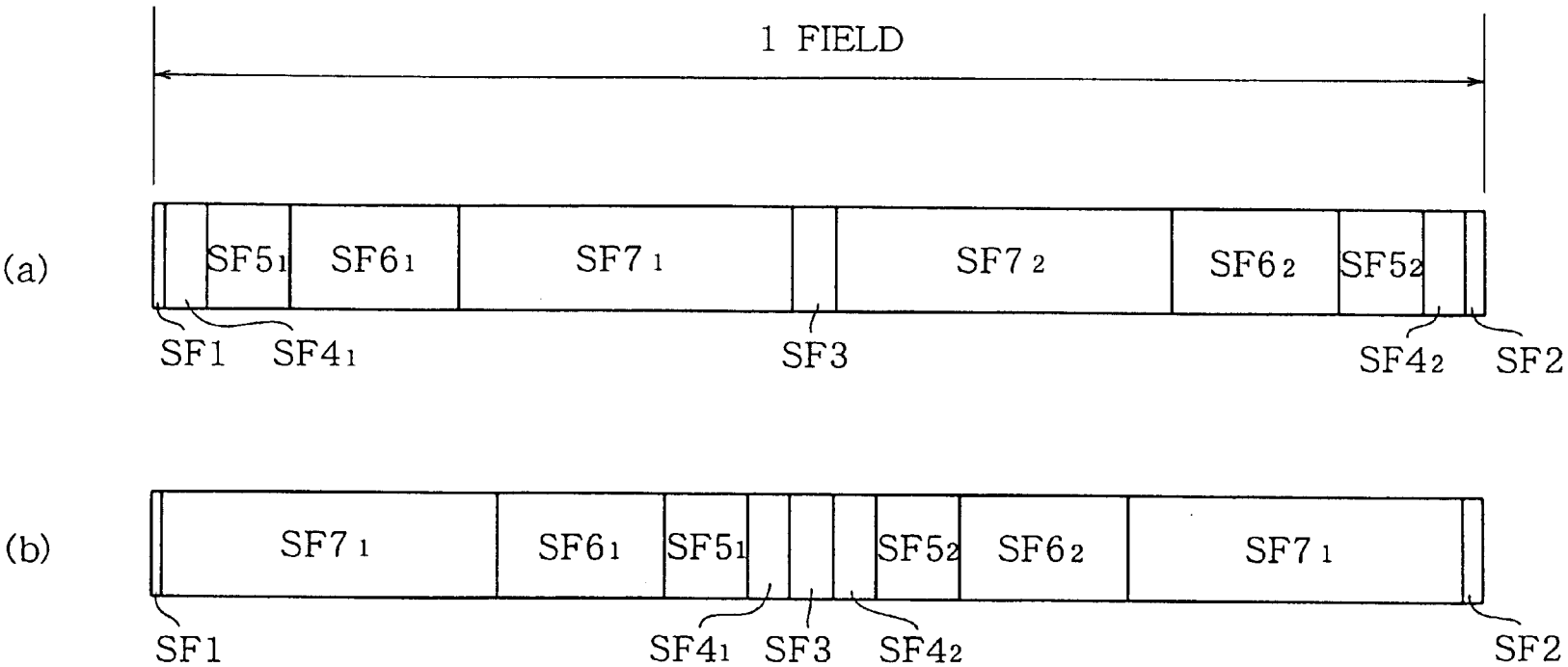
FIGS. 15*a* and 15*b* are diagram showing a modification of the light emitting formats for the field.

FIGS. 15*a* and 15*b* show modifications of the format of the sub-fields of the present invention for effectively reducing the false contour. Each field is divided into seven sub-fields SF7 to SF1 for the tone of 128 steps, as follows.

| |
|---|
| sub-field SF7: 64 |
| sub-field SF6: 32 |
| sub-field SF5: 16 |
| sub-field SF4: 8 |
| sub-field SF3: 4 |
| sub-field SF2: 2 |
| sub-field SF1: 1 |

The heaviest sub-field SF7 is divided into sub-fields $SF7_1$ and $SF7_2$ each of which has the ratio of weight 32. The second heaviest sub-field SF6 is divided into sub-fields $SF6_1$ and $SF6_2$ each of which has the ratio of weight 16. The sub-field SF5 is divided into sub-fields $SF5_1$ and $SF5_2$ each of which has the ratio of weight 8. The sub-field SF4 is divided into sub-fields $SF4_1$ and $SF4_2$ each of which has the ratio of weight 4. In the light emitting patterns shown in FIGS. 15*a* and 15*b,* sub-fields SF1, SF2 and SF3 are arranged in the same positions, and sub-fields $SF4_1$ to $SF7_1$ and $SF7_2$ to $SF4_2$ are reversely disposed.

Figure 16:
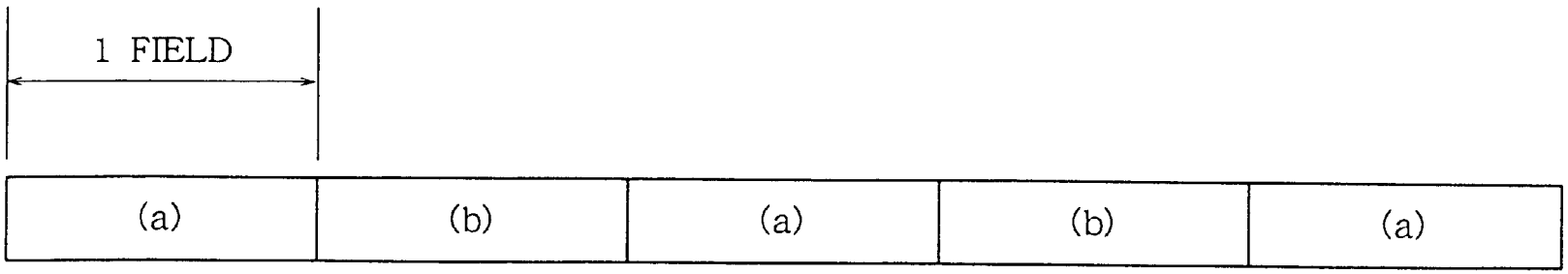
FIG. 16 is a diagram showing light emitting operation by the formats of FIGS. 15*a* and 15*b;*

FIG. 16 shows a light emitting operation by the formats shown in FIGS. 15*a* and 15*b* which are alternately disposed every field. The light emitting operation may be performed every frame.

In the modifications, since the sub-field is not overlapped with each other, obstacle by dots is reduced.

In accordance with the present invention, the false contour recognized in the area where the high-figure bit of the pixel data changes is prevented. Furthermore, it is possible to preferably display an image without the false contour even if the image is moved on the display.

While the invention has been described in conjunction with preferred specific embodiment thereof, it will be understood that this description is intended to illustrate and not limit the scope of the invention, which is defined by the following claims.

What is claimed is:

1. A driving system for a self-luminous display, wherein one field of a video signal is divided into a plurality of sub-fields, each of the sub-field is different from other sub-field in weight which determines a light emitting period of the sub-field, in which at least one of heavily weighted sub-fields is divided into a plurality of short sub-fields, the system comprising:

a plurality of tables, each of the tables storing a plurality of converting pixel data, each of the converting pixel data being different from other converting pixel data in weight in accordance with a luminance level applied thereto, wherein a converting pixel data is different from another converting pixel data stored in another table in light emitting pattern with respect to the same luminance level;

detector means for detecting difference between a pixel data of a selected central pixel in a picture and pixel data of pixels adjacent to the central pixel in logical value at heavier bits of a pixel data, and producing a first select signal when there is a difference, and a second select signal when there is no difference;

select means responsive to the first and second select signals for selecting one of the converting pixel data which is different in table in accordance with distinction of the select signal;

a frame memory for storing a selected converting pattern data; and driving means for driving a corresponding pixel for a period dependent on the selected converting pixel data derived from the frame memory.

2. The system according to claim 1 wherein the converting pixel data includes a first converting pixel data, a second converting pixel data and a third converting pixel data.

3. The system according to claim 2 wherein the first converting pixel data or the second converting pixel data is selected when the first select signal is produced.

4. The system according to claim 1 wherein the detector means comprises a comparator for comparing a pixel data of one of adjacent pixels with a pixel data of a selected central pixel at a most significant bit, and producing the first select signal of a logic level "1".

5. The system according to claim 1 wherein the detector means produces the first select signal when even one of adjacent pixels differs from the central pixel in pixel data.

6. The system according to claim 1 wherein each of the converting pixel data is different in light emitting timing from other converting pixel data in accordance with a luminance level applied thereto.

7. A method for driving a self-luminous display, wherein one field of a video signal is divided into a plurality of sub-fields, each of the sub-field is different from other sub-field in weight, in which at least one of heavily weighted sub-fields is divided into a plurality of short sub-fields, the steps comprising:

storing a plurality kinds of converting pixel data in corresponding tables, each kind of the converting pixel data being different from each other, patterns in the pattern set be associated with a corresponding pixel luminance intensity value kinds of converting pixel data in weight in accordance with a luminance level applied thereto, wherein a converting pixel data is different from another converting pixel data stored in another table in light emitting pattern with respect to the same luminance level;

detecting difference between a pixel data of a selected central pixel in a picture and pixel luminance intensity value of any pixels adjacent to the central pixel in logical value at heavier bits of a pixel data, and producing a first select signal when there is a difference, and a second select signal when there is no difference;

selecting one of the converting pixel data in accordance with the production of the first signal and the second signal distinction of the select signal;

storing a selected converting pixel data in a frame memory; and driving a corresponding pixel in accordance with the selected converting pixel data derived from the frame memory.

8. A driving system for a self-luminous display, comprising:

a plurality of tables, each of the tables storing a plurality of patterns respectively for a plurality pixel luminous intensity values, each of the tables storing a different set of patterns;

detector means for detecting a difference between a pixel luminous intensity value of a selected central pixel in a picture with any of pixel luminous intensity values of pixels adjacent to the central pixel, and producing a first select signal when there is a difference, and a second select signal when there is no difference;

select means responsive to the first and second select signals for selecting one of the plurality of tables and a pattern from the selected table based upon a pixel luminous intensity of the central pixel;

a frame memory for storing a selected pattern; and driving means for driving a corresponding pixel in accordance with the selected pattern derived from the frame memory.

9. The system according to claim 8 wherein the plurality of tables include first, second and third tables respectively storing a plurality of first patterns, a plurality of second patterns and a plurality of third patterns.

10. The system according to claim 9 wherein the first table or the second table is selected when the first select signal is produced.

11. The system according to claim 8 wherein the detector means comprises a comparator for comparing a most significant bit of a pixel luminous intensity value of one of the adjacent pixels with a most significant bit of the pixel luminous intensity value of the selected central pixel.

12. The system according to claim 8 wherein the detector means produces the first select signal when even one of adjacent pixels differs form the central pixel in pixel luminous intensity value.

13. The system according to claim 8 wherein for each pixel luminous intensity value greater than a certain value, each corresponding pattern is different in light emitting timing for each table.

14. A method for driving a self-luminous display, comprising:

storing a plurality of kinds of pattern sets in corresponding tables, each pattern set being different from each other, patterns in the pattern set being associated with a corresponding pixel luminous intensity value;

detecting a difference between a pixel luminous intensity value of a selected central pixel in a picture with a pixel luminous intensity value of any pixels adjacent to the central pixel, and producing a first select signal when there is a difference, and a second select signal when there is no difference;

selecting one of the tables and a pattern from the selected table based upon a pixel luminous intensity value of the central pixel in accordance with the production of the first signal and the second signal;

storing the selected pattern in a frame memory; and driving a corresponding pixel in accordance with the selected pattern derived from the memory.

* * * * *